United States Patent [19]

Iannelli

[11] Patent Number: 4,501,383

[45] Date of Patent: Feb. 26, 1985

[54] HOUSING FOR A PRESSURIZED SYRUP PACKAGE

[76] Inventor: Frank M. Iannelli, 5215 Pogue St., Spartanburg, S.C. 29301

[21] Appl. No.: 414,386

[22] Filed: Sep. 2, 1982

[51] Int. Cl.[3] ..... B67D 5/54

[52] U.S. Cl. ..... 222/82; 222/85; 222/88; 222/131; 222/325; 222/399

[58] Field of Search ..... 222/80, 81, 82, 85, 222/86, 88, 129, 130, 131, 173, 183, 325, 394, 399

[56] References Cited

U.S. PATENT DOCUMENTS

| | | | |
|---|---|---|---|
| 2,076,893 | 4/1937 | Johnson | 222/131 X |
| 3,752,362 | 8/1973 | Risener | 222/85 |
| 4,058,120 | 11/1977 | Caparrelli et al. | 222/325 X |
| 4,264,019 | 4/1981 | Roberts et al. | 222/325 X |
| 4,323,171 | 4/1982 | Whorton et al. | 222/82 |

FOREIGN PATENT DOCUMENTS

| | | | |
|---|---|---|---|
| 2449861 | 4/1975 | Fed. Rep. of Germany | 222/399 |

*Primary Examiner*—Joseph J. Rolla
*Assistant Examiner*—Lawrence J. Miller
*Attorney, Agent, or Firm*—Dority & Manning

[57] ABSTRACT

A housing for a pressurized syrup package which includes a main body portion constructed of material impervious to carbon dioxide. A cap is provided for the housing and extends over an open top of the main body portion. Piercing pins are carried by the cap for penetrating the top wall of the syrup package when the cap is positioned thereon to provide communication between a source of carbon dioxide and a receiver for syrup removed from the package. A conduit extends between the source of carbon dioxide and a respective piercing pin. A valve is positioned in the conduit for closing off the source of carbon dioxide automatically upon removal of the cap from the main body portion.

7 Claims, 1 Drawing Figure

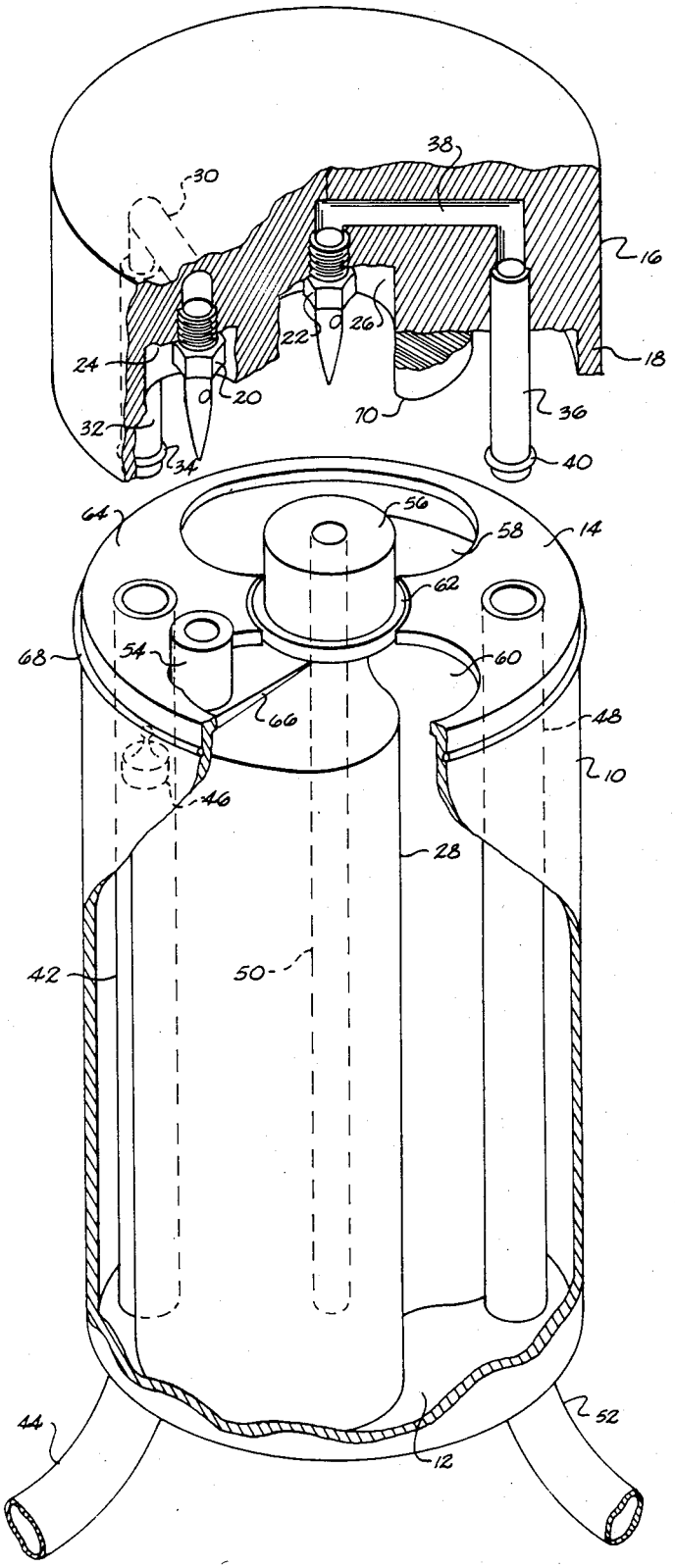
38
30
16
22
26
24
20
18
70
36
32
34
40
64
56
58
14
62
68
54
60
66
48
10
46
28
42
50
44
52
12

HOUSING FOR A PRESSURIZED SYRUP PACKAGE

BACKGROUND OF THE INVENTION

Syrup containers which have penetratable wall portions have been recommended for use in beverage dispensing devices such as disclosed in U.S. Pat. No. 4,323,171. In such a beverage dispensing device, the syrup package is constructed of polyethylene so that piercing pins can easily penetrate portions thereof for providing access to the interior of the package. One of the piercing pins is connected to a conduit that, in turn, is connected to a pressurized source of carbon dioxide so that carbon dioxide can be inserted into the package for forcing the syrup out through the other piercing pin.

One problem that has been encountered with such a device is that polyethylene is not impervious to carbon dioxide and the carbon dioxide will leak. If there is not a suitable valve positioned between the tank of carbon dioxide and the package, then eventually the entire tank will be exhausted.

Another syrup package which is provided for receiving piercing pins is disclosed in U.S. Pat. No. 3,685,694.

SUMMARY OF THE INVENTION

The present invention overcomes the above mentioned problems by providing a housing which is impervious to carbon dioxide for receiving a polyethylene syrup package. The housing includes a main body portion constructed of plastic material which is impervious to carbon dioxide. One suitable plastic material is manufactured by General Electric under the trade name Valox. The housing has a seal bottom and an open top so that a syrup package can be inserted therein. A cap is provided for the housing and extends over the open top of the main body portion. A seal is positioned between the main body portion and the interior wall of the cap so that when the cap is inserted on top of the main body portion, a sealed coupling is provided.

Piercing pins are carried by the cap and extend downwardly therefrom so that when the cap is positioned on top of the main body portion of the housing, the piercing pins penetrate the syrup package for providing access thereto. Conduits are connected to the piercing pins. Carbon dioxide is fed to the syrup package through one conduit and a piercing pin, and the syrup is removed from the package through the other conduit and a piercing pin.

In one particular embodiment, the conduit for transporting the carbon dioxide to the package includes a rigid portion carried within the main body of the housing. A valve is provided in the conduit for being opened by a rigid plunger carried by the cap. As a result, the source of carbon dioxide that is connected to the lower end of the conduit is isolated from the piercing pin and package when the cap is removed from the top of the housing. The plunger opens the valve when the cap is properly positioned on top of the housing allowing the carbon dioxide to flow through the first conduit for pressurizing the package.

Positioned on top of the main body of the housing is a cover which has a predetermined shaped opening provided therein corresponding to the cross sectional shape of the syrup package so that the syrup package can only be inserted in the main body portion of the housing in one particular position. This ensures proper alignment of the piercing pins with the desired portion of the package that is to be penetrated thereby.

Accordingly, it is an important object of the present invention to provide a housing for receiving a syrup package that is impervious to carbon dioxide.

Another important object of the present invention is to provide a housing for syrup packages which can be readily placed in an operative condition by merely inserting a cap thereon.

Still another important object is to provide a simple and reliable housing for accommodating syrup packages used in connection with beverage dispensing devices.

The construction designed to carry out the invention will be hereinafter described, together with other features thereof.

The invention will be more readily understood from a reading of the following specification and by reference to the accompanying drawing forming a part thereof wherein an example of the invention is shown and wherein:

BRIEF DESCRIPTION OF THE DRAWING

The drawing is a perspective view with parts broken away for purposes of clarity illustrating a housing constructed in accordance with the present invention.

DESCRIPTION OF A PREFERRED EMBODIMENT

Referring to the drawing, there is illustrated a housing for accommodating syrup packages such as could be used in a beverage dispensing device shown in U.S. Pat. No. 4,323,171. The normal use of such a beverage dispensing device would be for small capacity dispensers such as used in a home.

The housing includes a main body portion 10 constructed of Valox plastic material in the form of a cylinder. A bottom is integral therewith. The upper portion of the main body 10 is open and has a cover 14 extending thereover. The shape of the cover will be described more fully below.

A cap 16, constructed of molded Valox plastic material, is provided for being inserted on the upper end of the main body 10. The cap has a cylindrical flange 18 which extends downwardly therefrom. A pair of piercing pins 20 and 22 are carried within sockets 24 and 26 provided in the cap. The lower ends of the piercing pins 20 and 22 have sharpened points thereon so that when the cap is forced down over the top of the main body portion 10, the pins pierce a package 28 carried within the main body portion. In one particular embodiment, the package is constructed of polyethylene material.

The other end of piercing pin 20 is connected through conduit 30 which terminates in a vertically extending rigid plunger 32 hereinafter referred to as the first conduit. An O-ring 34 is provided on the bottom portion of the rigid plunger 32. A similar rigid plunger 36 is connected through conduit means 38 to the upper end of the piercing pin 22. An O-ring 40 is also carried on the lower end of the plunger 36.

A first conduit means 42 extends from the top of the main body portion of the bottom. The upper end of the first conduit means 42 is open for receiving the rigid plunger 32, and the lower end thereof has internal threads provided thereon (not shown) for receiving a coupling provided on a flexible tube 44 which, in turn, is connected to a source of pressurized carbon dioxide.

Interposed in the first conduit means 42 is a pneumatic valve 46 similar to the valve that is commonly used in bicycle tires.

The purpose of the valve 46 is to automatically disconnect the source of pressurized carbon dioxide when the cap is removed.

Such performs two functions. It automatically disconnects the pressurized source of carbon dioxide from the package, and it allows the package to be vented back through the piercing pin 20 as the cap is being removed. The short time required for lifting the cap is sufficient to de-pressurize the package to prevent syrup from blowing thereout upon removing the cap. A second conduit 48 is carried on the opposite side of the housing and extends from the top to the bottom for conveying the syrup that is forced out of the package through tube 50, piercing pin 22, and rigid plunger 36 to the flexible tube 52.

The plungers 32 and 36 ensure that the cap is properly positioned on the housing.

When the cap 16 is inserted on top of the main body portion, the piercing pin 20 pierces through the top of an upwardly projecting projection 54 carried on top of the package. Similarly, the piercing pin 22 extends into the top surface of the centrally located projection 56 carried by the package.

The package has a cross-section shape which is complementary to two openings 58 and 60 which are joined by a cylindrical opening 62 carried in a cover 64. This is to ensure proper positioning of the package relative to the piercing pins 20 and 22.

In operation, the package is first inserted into the housing and then twisted clockwise until the projection 54 abuts against the edge of the cover 64 as shown in the drawing. Downwardly protruding positioning blocks 70 are carried on the bottom of the cap which abut against an edge 66 of the package for locking the package in position. That is, one side of the projecting member 54 will be pressing against the edge extending around the opening 60 and the other side will be abutting against the downwardly protruding positioning block carried on the bottom surface of the cap. It is to be understood, of course, that any suitable positioning member can be utilized with the cap and housing for ensuring that the package is properly positioned thereon prior to inserting the cap on the package.

An "O" ring 68 is carried adjacent the top of the main body portion 10 for providing a seal between the main body portion and the cap 16.

What is claimed is:

1. A housing for a pressurized syrup package used in a beverage dispensing machine comprising:

a main body portion constructed of material impervious to carbon dioxide, having a sealed bottom and open top;

said main body portion being of sufficient size for receiving a syrup package inserted therein through said top;

a cap provided for extending over said open top of said main body portion;

seal means carried between said cap and said main body portion providing a sealed chamber for said syrup package when said cap is inserted on said main body portion;

piercing pins carried by said cap for piercing said syrup package when said cap is positioned on said main body portion;

conduit means connected to said piercing pins through which carbon dioxide can be fed to said syrup package for pressurizing said package and for removing syrup from said package; and said conduit means including:

(i) a first conduit carried within said main body portion of said housing;

(ii) a source of carbon dioxide connected to said first conduit;

(iii) valve means carried in said first conduit;

(iv) a rigid plunger connected to one of said piercing pins and extending downwardly below said cap for opening said valve when said cap is inserted on said housing connecting said one of said piercing pins to said source of carbon dioxide.

2. The housing as set forth in claim 1 further comprising:

said first conduit having an opened top terminating adjacent the top of said main body portion and an opened bottom terminating adjacent the bottom of said main body portion.

3. The housing as set forth in claim 1 further comprising:

a cover extending over the top of said main body portion;

predetermined shaped openings provided in said cover corresponding to the cross sectional shape of said syrup package whereby said syrup package is rotated into proper orientation after being inserted into said housing for ensuring proper positioning of said piercing pins relative to said syrup package.

4. The housing as set forth in claim 1 further comprising:

said piercing pins being recessed in sockets provided in said cap;

said sockets being arranged to receive complementary shaped projections carried on the top of said syrup package to ensure proper positioning of said syrup package relative to said cap.

5. The housing for a pressurized syrup package used in a beverage dispensing machine as set forth in claim 1 further comprising:

said cap being of molded plastic material with said piercing pins projecting downwardly so that upon pressing with the palm of one's hand onto the top of said cap, said piercing pins penetrate said syrup package carried in said housing.

6. A housing for a pressurized syrup package used in a beverage dispensing machine comprising:

a main body portion constructed of material impervious to carbon dioxide, having a sealed bottom and open top;

said main body portion being of sufficient size for receiving a syrup package inserted therein through said top;

a cap provided for extending over said open top of said main body portion;

seal means carried between said cap and said main body portion providing a sealed chamber for said syrup package when said cap is inserted on said main body portion;

piercing pins carried by said cap for piercing said syrup package when said cap is positioned on said main body portion;

conduit means connected to said piercing pins through which carbon dioxide can be fed to said syrup package for pressurizing said package and for removing syrup from said package;

a cover extending over the top of said main body portion;

predetermined shaped openings provided in said cover corresponding to the cross sectional shape of said syrup package whereby said syrup package is rotated into proper orientation after being inserted into said housing for ensuring proper positioning of said piercing pins relative to said syrup package; and said shaped openings of said cover having a curved abutment edge for receiving a package projection extending upwardly from said syrup projection, said abutment edge abutting said projection to properly position said syrup package in said housing.

7. The housing as set forth in claim 6 wherein said cap includes a downwardly protruding positioning block which engages said syrup package to lock said package projection in said abutting position against said abutment edge of said shaped opening.

* * * * *